US011586132B2

(12) United States Patent
Kojima

(10) Patent No.: US 11,586,132 B2
(45) Date of Patent: Feb. 21, 2023

(54) ELECTROPHOTOGRAPHIC BELT AND ELECTROPHOTOGRAPHIC IMAGE FORMING APPARATUS

(71) Applicant: CANON KABUSHIKI KAISHA, Tokyo (JP)

(72) Inventor: Hiroomi Kojima, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/697,075

(22) Filed: Mar. 17, 2022

(65) Prior Publication Data

US 2022/0308504 A1 Sep. 29, 2022

(30) Foreign Application Priority Data

Mar. 24, 2021 (JP) ..... JP2021-050144
Mar. 15, 2022 (JP) ..... JP2022-040164

(51) Int. Cl.
*G03G 15/16* (2006.01)

(52) U.S. Cl.
CPC ..... *G03G 15/162* (2013.01)

(58) Field of Classification Search
CPC ..... G03G 15/162
See application file for complete search history.

(56) References Cited

U.S. PATENT DOCUMENTS 8,367,192 B2 2/2013 Kuraoka et al.
10,551,771 B2 2/2020 Uchida et al.
11,215,941 B2 1/2022 Egawa
2010/0239764 A1* 9/2010 Ichizawa ..... G03G 15/162 399/121
2012/0128953 A1* 5/2012 Kuraoka ..... B32B 27/20 428/215
2016/0349671 A1* 12/2016 Egawa ..... G03G 15/162
2019/0265605 A1* 8/2019 Koga ..... G03G 15/08
2019/0332040 A1* 10/2019 Yokoyama ..... G03G 15/162
2019/0377285 A1* 12/2019 Matsumoto ..... G03G 15/2064
2020/0401073 A1* 12/2020 Saito ..... G03G 15/162

FOREIGN PATENT DOCUMENTS

JP 2009-244354 A 10/2009
JP 2011-033942 A 2/2011
JP 2019-191568 A 10/2019
JP 2021-009358 A 1/2021

* cited by examiner

*Primary Examiner* — Carla J Therrien
(74) *Attorney, Agent, or Firm* — Venable LLP

(57) ABSTRACT

An electrophotographic belt includes: a base body having an endless shape; and a surface layer on an outer peripheral surface of the base body, wherein grooves extending in a circumferential direction are provided on an outer surface of the surface layer; the base body contains a thermoplastic polyester resin and a filler; the surface layer contains an acrylic resin; a thickness T of the base body is 30 μm or larger, and a content of the filler in the base body is 0.1% by volume or more and 10.0% by volume or less based on a total volume of the base body; and in a region having a thickness 0.25 times as thick as an average particle diameter of the filler, an average value A of ratios of elements derived from the filler is 0.0 atomic % or larger and 1.0 atomic % or smaller.

6 Claims, 14 Drawing Sheets

ELECTROPHOTOGRAPHIC BELT AND ELECTROPHOTOGRAPHIC IMAGE FORMING APPARATUS

BACKGROUND

Technical Field

The present disclosure relates to an electrophotographic belt and an electrophotographic image forming apparatus.

Description of the Related Art

One example of image forming apparatuses for electrophotography (hereinafter, also referred to as "electrophotographic apparatus") is an electrophotographic apparatus having a cleaning blade that is arranged so as to abut on an outer peripheral surface which is a toner-carrying surface of an intermediate transfer belt having an endless shape. Then, as the intermediate transfer belt of which the outer peripheral surface is cleaned by the cleaning blade, an electrophotographic belt is used in some cases, which has an endless shape and has a groove extending in the circumferential direction on the outer peripheral surface. Thereby, a frictional force between the cleaning blade and the outer peripheral surface can be reduced and a cleanability of the outer peripheral surface can be enhanced. In Japanese Patent Application Laid-Open No. 2019-191568, disclosed is an electrophotographic belt having a plurality of grooves extending in the circumferential direction provided on the outer peripheral surface.

One example of electrophotographic apparatuses in recent years is an electrophotographic apparatus that has realized high color reproducibility. This electrophotographic apparatus forms a toner image for correction on a part of the outer peripheral surface of the intermediate transfer belt, detects the toner image for correction by detecting reflected light of light incident from an optical sensor, and controls an image based on the detection result. At this time, the optical sensor detects the toner image for correction by using a contrast between reflected light from a portion of the outer peripheral surface, on which the toner image for correction is not formed, and reflected light from the toner image for correction. Accordingly, in order to accurately detect the toner image for correction, it is effective to stabilize the amount of light reflected from the portion other than the toner image for correction on the outer peripheral surface of the electrophotographic belt. However, according to studies by the present inventors, in the electrophotographic belt having the groove on the outer peripheral surface, the light incident from the sensor has been irregularly reflected by the groove, and the amount of light reflected from the outer peripheral surface has fluctuated greatly depending on the position, in some cases.

SUMMARY

At least one aspect of the present disclosure is directed to providing an electrophotographic belt having a plurality of grooves on an outer peripheral surface, in which the amount of light reflected from the outer peripheral surface is stable. Another aspect of the present disclosure is directed to providing an electrophotographic image forming apparatus that can stably form a high-quality electrophotographic image.

According to one aspect of the present disclosure, there is provided an electrophotographic belt having an endless shape, including: a base body having an endless shape; and a surface layer on an outer peripheral surface of the base body, wherein a plurality of grooves extending in a circumferential direction are provided on an outer surface of the surface layer; the base body contains a thermoplastic polyester resin and a filler; the surface layer contains an acrylic resin; a thickness T of the base body is 30 μm or larger, and a content of the filler in the base body is 0.1% by volume or more and 10.0% by volume or less based on a total volume of the base body; and in a region having a thickness 0.25 times as thick as an average particle diameter of the filler, from a first surface of the surface layer on a side facing the base body, toward a second surface opposite to the first surface, an average value A of ratios of elements derived from the filler is 0.0 atomic % or larger and 1.0 atomic % or smaller.

In addition, according to another aspect of the present disclosure, there is provided an electrophotographic image forming apparatus including the above electrophotographic belt as an intermediate transfer belt.

Further features of the present disclosure will become apparent from the following description of exemplary embodiments with reference to the attached drawings.

DESCRIPTION OF THE EMBODIMENTS

Figure 1:
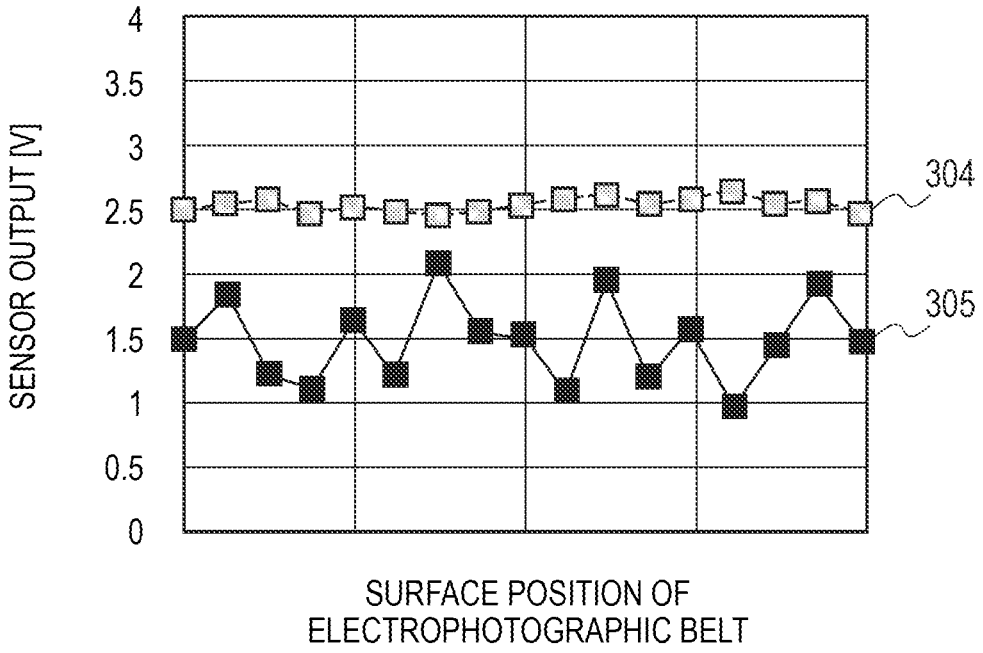
FIG. 1 illustrates a graph illustrating one example of respective outputs from a sensor that has received regular reflection light of light emitted to outer surfaces of an electrophotographic belt having a groove on an outer peripheral surface, and of an electrophotographic belt having no groove on an outer peripheral surface.

The outer peripheral surface of the electrophotographic belt is irradiated with light from a sensor, and an output from the sensor which has received the regular reflection light is defined as an output 304. In addition, the outer peripheral surface of the electrophotographic belt having a plurality of grooves extending in the circumferential direction on the outer peripheral surface is irradiated with light from the sensor, and an output from the sensor which has received the regular reflection light is defined as an output 305. These outputs are illustrated in FIG. 1.

In the electrophotographic belt having no grooves on the outer peripheral surface, the output from the sensor is almost constant which has detected the regular reflection light from the outer peripheral surface thereof. On the other hand, in the electrophotographic belt having grooves on the outer peripheral surface, the output from the sensor greatly fluctuates which has detected the regular reflection light from the outer peripheral surface thereof. Because of this, when the toner image for correction is formed on the outer peripheral surface of such an electrophotographic belt, the output from the sensor becomes small even in the portion in which the toner image for correction does not exist, and there has been a case where it results in being determined as if the toner image for correction exists there.

Here, the reflected light that is received by the sensor includes a component of reflected light from the outermost surface and a component of reflected light from the base body. Specifically, a part of incident light emitted from the optical sensor includes a component that passes through the surface layer, reaches the base body, is reflected by the base body, and is received by the sensor.

Then, the present inventors have studied suppressing the fluctuation of the amount of the reflected light due to the existence of the groove, by increasing the ratio of a component of the reflected light from the base body to a component of the reflected light from the outermost surface of the outer peripheral surface which tends to be easily affected by the groove, among the reflected light received by the sensor. As a result, the present inventors have found that the amount of the reflected light received by the sensor can be stabilized even when the outer peripheral surface has a groove, by allowing the base body to contain a predetermined amount of filler, and controlling an existence state of the filler in an interfacial region between the base body and the surface layer.

An electrophotographic belt according to one aspect of the present disclosure includes a base body having an endless shape, and a surface layer on the outer peripheral surface of the base body; and a plurality of grooves extending in the circumferential direction are provided on the outer surface of the surface layer.

The base body is formed from a thermoplastic resin composition containing a thermoplastic polyester resin, a filler, and preferably an electroconductive agent, and the surface layer is formed from an acrylic resin composition.

The base body has a thickness T of 30 μm or larger, and the content of the filler in the base body is 0.1% by volume or more and 10% by volume or less based on the total volume of the base body.

In addition, a region having a thickness 0.25 times as thick as an average particle diameter of the filler, from a first surface B1 of the surface layer on a side facing the base body, toward a second surface B2 opposite to the first surface B1, is defined as a "region Y". An average value A of ratios of an element derived from the filler in the region Y is 0.0 atomic % or larger and 1.0 atomic % or smaller.

Specifically, with the base body having a thickness of 30 μm or larger and containing the filler in an amount of 0.1% by volume or more and 10.0% by volume or less based on the total volume of the base body, the light from the sensor, which has passed through the surface layer, can be reflected more reliably. In addition, with an average value A of ratios of the element derived from the filler in the interfacial region between the surface layer and the base body, specifically in the region Y, of 0.0 atomic % or larger and 1.0 atomic % or smaller, irregular reflection that is caused by the filler in the interfacial region can be prevented. Because of this, the light from the sensor, which has passed through the surface layer, can be returned more reliably to a light receiving sensor. As a result, even an electrophotographic belt having grooves formed on the outer surface thereof can further stabilize the regular reflection light of the light emitted from the sensor to the outer peripheral surface, which the light receiving sensor receives.

An electrophotographic endless belt according to one aspect of the present disclosure will be described below in detail with reference to the drawings. Note that the present disclosure is not limited to the following aspects.

<Electrophotographic Belt>

Figure 2:
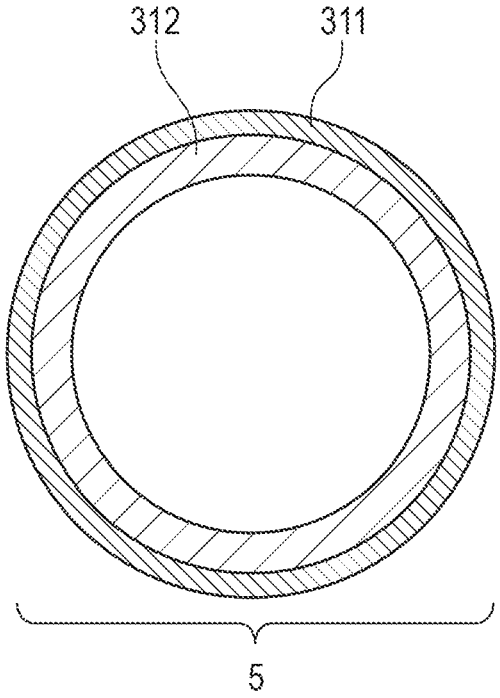
FIG. 2 illustrates a schematic cross-sectional view illustrating a configuration of an electrophotographic belt according to one aspect of the present disclosure.
Figure 3:
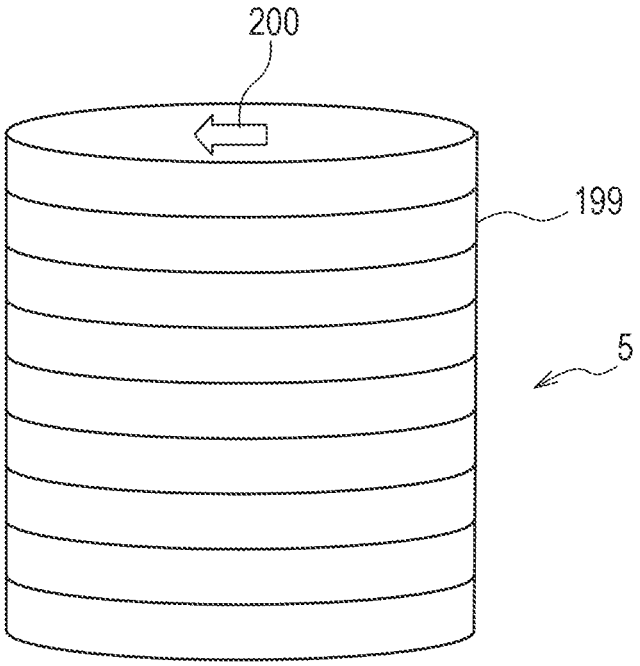
FIG. 3 illustrates a schematic view illustrating a configuration of the surface of an electrophotographic belt according to one aspect of the present disclosure.

FIG. 2 illustrates a schematic cross-sectional view illustrating an aspect of an electrophotographic belt according to the present disclosure. FIG. 3 illustrates a schematic view illustrating a configuration of the surface of the electrophotographic belt.

As is illustrated in FIG. 2, an electrophotographic belt 5 according to the present disclosure includes a base body 312, and a surface layer 311 on an outer peripheral surface of the base body 312.

Figure 4:
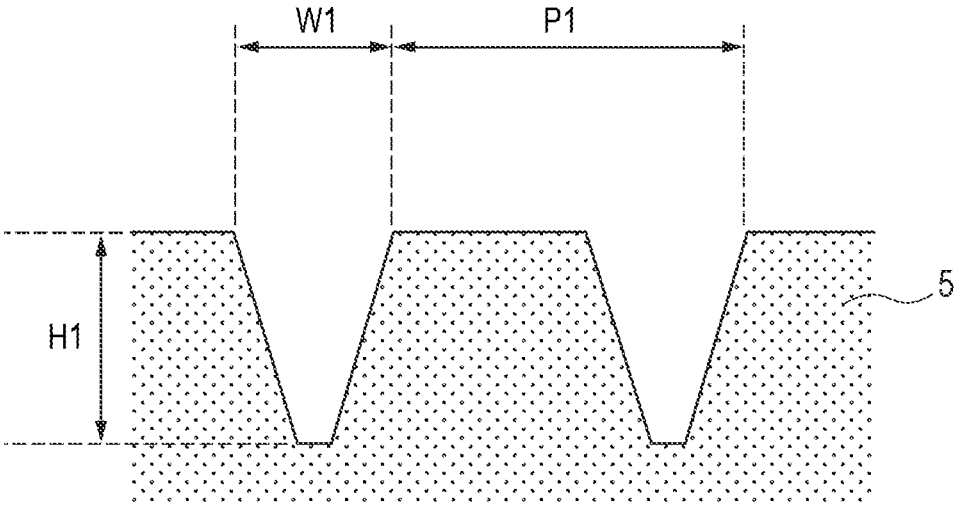
FIG. 4 illustrates a schematic view in which groove portions in a cross section in a direction orthogonal to a circumferential direction of the electrophotographic belt are enlarged which is illustrated in FIG. 3.

As is illustrated in FIG. 3, a plurality of grooves 199 are provided in a direction orthogonal to the circumferential direction (also referred to as width direction), on the surface of the side of the surface layer of the electrophotographic belt 5, which is opposite to the base body side. The grooves are provided almost in the circumferential direction 200 of the electrophotographic endless belt. It is preferable that the groove 199 is continuous in the circumferential direction. In addition, the groove can also be a single groove which continues in a spiral shape, and also in this case, a plurality of grooves result in existing in the width direction. Alternatively, a plurality of spiral grooves may be provided. FIG. 4 is an enlarged view of a surface portion in which the groove is provided, in a cross-sectional view in a direction orthogonal to the circumferential direction of the belt 5. In FIG. 4, W1 represents a width of the groove, H1 represents a depth of the groove, and P1 represents a distance between the grooves.

The number n of the grooves is one or two or more, and is not particularly limited as long as toner can be stably cleaned, but is preferably 2000 to 120000 in the width direction, in an electrophotographic endless belt of which the width is 250 mm. When the number is 2000 or more, an area of a portion of a cleaning blade decreases, which abuts on a portion at which the groove is not provided, and thereby a frictional force that is generated between the cleaning blade and the electrophotographic endless belt can be reduced. When the number is 120000 or less, the toner existing in the groove can be transferred more satisfactorily.

The distance P1 between adjacent grooves is not particularly limited as long as the number of grooves is within the above range, but is preferably approximately equal to each other, and is more preferably 2.0 μm or larger and 125 μm or smaller from the viewpoint of cleaning of the toner. When the distance P1 is 125 μm or smaller, the number of grooves provided on the surface of the electrophotographic endless belt of which the width is 250 mm becomes 2000 or more. Because of this, the blade resists the occurrence of local wear, and an abutting state between the cleaning blade and the electrophotographic belt can be stabilized for a long period of time. In addition, when the distance is 2.0 μm or larger, the number of grooves to be provided becomes 120000 or less, and the electrophotographic belt can keep the transferability of the toner existing on the grooves.

It is preferable for a width W1 of the groove to be 0.10 μm or larger and smaller than 3.0 μm, and is more preferable to be 0.20 μm or larger and smaller than 2.0 μm. When the width is 0.10 μm or larger, the electrophotographic belt can suppress the disappearance of grooves due to wear of its surface. When the width is 3.0 μm or smaller, the electrophotographic belt can maintain the transferability of the toner existing on the groove, and can keep its image quality.

The depth H1 of the groove is preferably set to 15% or larger and 35% or smaller of the thickness T1 of the surface layer, and is usually set in a range of 0.10 μm or larger and smaller than 2.0 μm. When the depth is 15% or larger of the thickness T1 of the surface layer, the disappearance of the groove due to the wear of the surface of the electrophotographic belt can be suppressed. When the depth is 35% or smaller of the thickness T1 of the surface layer, the possibility of breakage of the surface layer is small.

As a working method for forming the groove, a known working method such as, for example, cutting working, etching working and imprint working can be used, but the imprint working is preferable from the viewpoint of the working reproducibility of the groove and the working cost. In the imprint working, after a coating film of the surface layer has been formed on the base body and has been cured, a mold having a salient corresponding to the groove is pressed against the coating film, and the groove can be formed on the surface layer by transfer.

<Base Body>

The base body includes a thermoplastic polyester resin and a filler. The thickness T of the base body is 30 μm or larger, and is preferably 50 μm or larger, in order to reduce the permeation of the incident light emitted from the optical sensor. The upper limit of the thickness T is not particularly limited, but is usually 500 μm or smaller, and preferably is 100 μm or smaller.

From the viewpoint of possibility of enhancement in strength, it is preferable that the base body is stretched in the circumferential direction and a direction orthogonal to the circumferential direction. In addition, from the viewpoint of flexibility, it is preferable that a tensile elastic modulus Ep in the circumferential direction and a tensile elastic modulus Ea in a direction orthogonal to the circumferential direction of the belt are both 1200 MPa or larger.

<Thermoplastic Polyester Resin>

The thermoplastic polyester resin can be obtained by polycondensation of a dicarboxylic acid and a diol, polycondensation of an oxycarboxylic acid or a lactone, or polycondensation with the use of a plurality of these components and the like. It is also acceptable to further use a polyfunctional monomer in combination. The thermoplastic polyester resin may be a homopolyester containing one type of ester bond, or a copolyester (copolymer) containing a plurality of ester bonds.

Preferable examples of the thermoplastic polyester resin include at least one selected from the group consisting of a polyalkylene terephthalate and a polyalkylene naphthalate which have high crystallinity and exhibit excellent heat resistance. In addition, a copolymer of polyalkylene naphthalate and polyalkylene isophthalate can be preferably used. The form of the copolymer at this time may be any of a block copolymer and a random copolymer.

From the viewpoint of high crystallinity and heat resistance, the number of carbon atoms of alkylene in the polyalkylene terephthalate, the polyalkylene naphthalate and the polyalkylene isophthalate is preferably 2 or more and 16 or less. More specifically, as the thermoplastic polyester resin, the polyethylene terephthalate, the polyethylene naphthalate, and a copolymer of the polyethylene terephthalate and the polyethylene isophthalate are preferable.

In addition, the content of the thermoplastic polyester resin in the thermoplastic resin composition is preferably 50% by mass or more, is more preferably 60% by mass or more, and is further preferably 70% by mass or more, with respect to the total mass of the thermoplastic resin composition. When the content of the thermoplastic polyester resin is controlled to 50% by mass or more with respect to the total mass of the thermoplastic resin composition, it is easy to enhance a mechanical strength of the thermoplastic resin composition.

<Filler>

The filler is contained in the base body in order to surely regularly reflect the light that has been incident from the outer peripheral surface of the electrophotographic belt according to one aspect of the present disclosure and has passed through the surface layer, and returns the reflected light to the light receiving sensor. Thus, the base body contains 0.1% by volume or more and 10.0% by volume or less of the filler, based on the total volume of the base body. The content of the filler in the base body may preferably be 0.5% by volume or more and 5.0% by volume or less, with respect to the total volume of the base body.

Examples of such fillers include the followings: calcium carbonate, talc, clay, wollastonite, potassium titanate, barium titanate, lead zirconate titanate, an aramid particle, mica, a glass bead, a glass balloon, zeolite, alumina, ferrite, barium sulfate, molybdenum sulfide, magnesium oxide, calcium oxide, hydrotalcite, zinc oxide, iron oxide, carbon black, a carbon fiber, a carbon nanotube, a carbon nanofiber, electroconductive titanium oxide, electroconductive tin oxide, electroconductive mica, calcium sulfate, strontium titanate, titanium oxide, magnesium hydroxide, aluminum hydroxide, kaolin, silica, a silicone particle, a PTFE particle, a PFPE particle, a PFA particle, barium carbonate, nickel carbonate, quartz powder, and a fine particle of a thermosetting resin. These may be used singly or in combination of two or more thereof.

The shape and size of the filler are not particularly limited, but a spherical shape is preferable. This is because when the filler is spherical, it is easier to obtain isotropy in terms of a dispersed state and an oriented state, as compared with an irregularly shaped particle or a fibrous material, regardless of a manufacturing method of the electrophotographic belt. If the isotropy is obtained, stable reflected light can be obtained with respect to the incident light emitted from an image control optical sensor, regardless of the dispersed state or the oriented state.

Among the above fillers, silica and a silicone resin particle are preferable because they can further increase the amount of light reflected from the base body.

<Electroconductive Agent>

The base body can also contain an electroconductive agent.

Examples of the electroconductive agent include: a low-molecular ion conductive agent such as a surfactant and an ionic liquid; and an electroconductive polymer such as a polyether ester amide. In addition, if necessary, two or more types of these electroconductive agents may be blended in appropriate amounts, and be used.

<Additive>

Other components may be added to the base body in such a range that the effects of the electrophotographic belt according to the present disclosure are not impaired. Examples of the other components include an electroconductive macromolecular compound, an antioxidant, an ultraviolet absorber, an organic pigment, an inorganic pigment, a pH adjuster, a crosslinking agent, a compatibilizer, a mold release agent, a coupling agent and a lubricant. These additives may be used singly or in combination of two or more thereof. The amount of the additive to be used can be appropriately set, and is not particularly limited.

The thermoplastic resin composition according to the present disclosure can be obtained by hot-melt kneading the thermoplastic polyester resin and the filler.

The hot-melt kneading means to heat the thermoplastic polyester resin to be contained in the thermoplastic resin composition and knead the heated resin in a molten state. At the time of the hot-melt kneading, in order that the thermoplastic polyester resin having the highest melting point among the thermoplastic polyester resins to be contained in the thermoplastic resin composition will be kneaded satisfactorily, it is preferable to perform kneading at a temperature equal to or higher than the highest melting point.

The kneading method is not particularly limited, and a single-screw extruder, a twin-screw kneading extruder, a Banbury mixer, a roll, Brabender, Plastograph, a kneader and the like can be used.

As previously described, the base body having the endless belt shape can be obtained by pelletizing the thermoplastic resin composition that has been obtained by the hot-melt kneading, and forming the pelletized thermoplastic resin composition with the use of a known forming method.

Examples of the known forming method include a continuous melt extrusion method, an injection molding method, a stretch blow forming method and an inflation forming method. Among the methods, a stretch blow forming method is more preferable in which the base body is stretched in two axial directions and the strength thereof can be increased.

<Surface Layer>

The surface layer 13 contains an acrylic resin. The thickness T1 of the surface layer is not particularly limited, but is preferably 0.1 μm or larger and 50 μm or smaller. If the thickness is in the above range, the surface layer can maintain the formed groove shape even by repeated use, and can easily suppress the occurrence of cracking due to repeated bending. The acrylic resin to be used in the acrylic resin composition is preferably a polyfunctional acrylate monomer. Usable examples of the polyfunctional acrylate monomer include: dipentaerythritol pentaacrylate, dipentaerythritol hexaacrylate, pentaerythritol triacrylate, pentaerythritol tetraacrylate, trimethylolpropane triacrylate, trimethylolpropane PO-modified triacrylate, trimethylolpropane EO-modified triacrylate, isocyanuric acid EO-modified triacrylate, ditrimethylolpropane tetraacrylate, diglycerin EO-modified acrylate, and bisphenol EO-modified diacrylate. Here, "EO" means "ethylene oxide" and "PO" means "propylene oxide." Each of these acrylic resins may be a homopolymer or a copolymer, or may be a mixture of a plurality of types of acrylic resins.

The acrylic resin composition may contain a fluororesin; fluororesins which are preferably used include polytetrafluoroethylene, perfluoropolyether, a perfluoroalkoxy fluororesin, polyvinylidene fluoride, polyvinyl fluoride, a tetrafluoroethylene-hexafluoropropylene copolymer, and an ethylene-tetrafluoroethylene copolymer; and the polytetrafluoroethylene (PTFE) is preferably used. The fluororesin may be a homopolymer or a copolymer, or may be a mixture of a plurality of types of fluororesins. In addition to the acrylic resin and the fluororesin, an electroconductive agent, an antioxidant, a dispersing agent and the like can be added to the acrylic resin composition, as necessary.

As a method for forming the surface layer, there are known forming methods such as dip coating, spray coating, flow coating, shower coating, roll coating, spin coating and ring coating; and by use of the forming method, the surface layer can be formed on the base body having the endless belt shape.

Figure 9A:
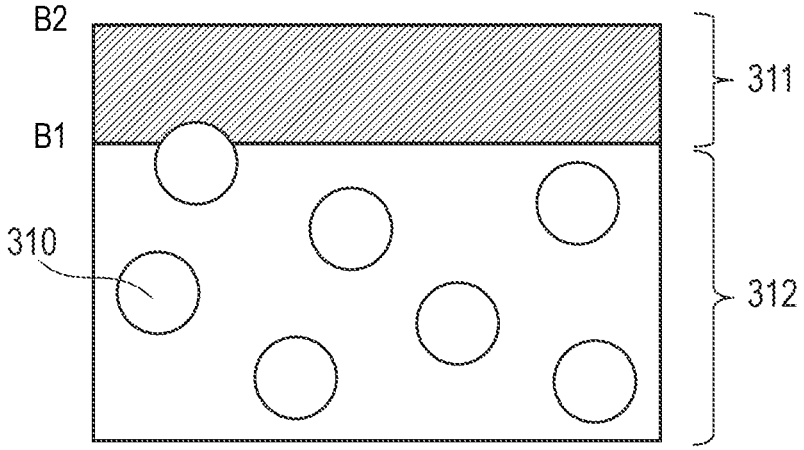
FIG. 9A and FIG. 9B illustrate a schematic cross-sectional view illustrating an interface (first surface B1) between a base body and a surface layer.
Figure 9B:
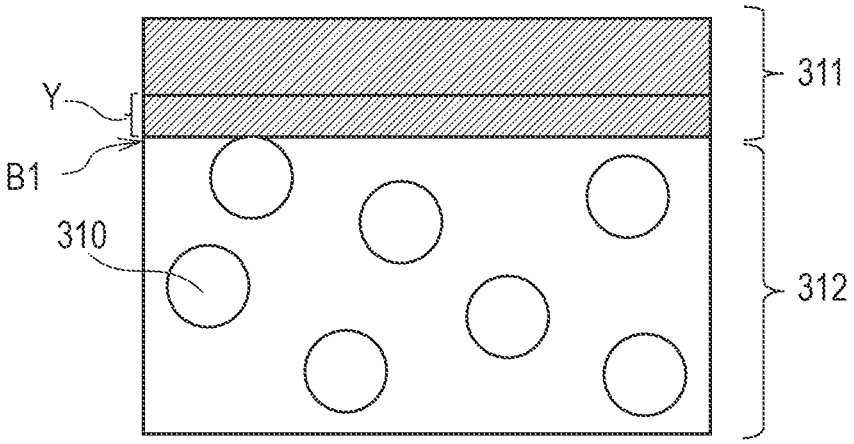

As will be described later, there is a case in the base body that is formed from the thermoplastic resin composition containing the thermoplastic polyester resin and the filler, where the filler is exposed on the outer peripheral surface depending on the manufacturing method, and a salient is formed on the outer peripheral surface thereof. In a case where the surface layer is formed on the base body in which a part of the filler is exposed and the salient is formed, a part of the filler 310 results in entering a side of the surface layer 311 in an interfacial region between the base body 312 and the surface layer 311, as is illustrated in FIG. 9A. There is a possibility that such a filler causes irregular reflection of the light reflected from the base body. Then, in the present disclosure, as illustrated in FIG. 9B, a region having a thickness 0.25 times as thick as the average particle diameter P of the filler, from an interface B1 (referred to as "first surface" of surface layer) between the base body and the surface layer, toward a second surface B2 of the surface layer, is defined as "interfacial region Y". An average value A of ratios of an element derived from the filler in the interfacial region Y is set to 0.0 atomic % or larger and 1.0 atomic % or smaller.

For information, the "element derived from the filler" is an element peculiar to the filler exemplified above that is added to the base body, and is preferably an element that is not contained in the acrylic resin composition constituting the surface layer. For example, in the case of the silicone particle or the silica, which are the above preferable fillers, the above element means a Si element. In addition, a carbon element and the like, in a carbon-based filler, a fluororesin particle such as PTFE, a fine particle of a thermosetting resin, and the like, can also be the above element, if the carbon element is distinguished from the same elements in the acrylic resin composition, based on the bonding state.

The average value A of ratios of the element derived from the filler can be confirmed by determining a distribution of the ratio of the element derived from the filler in the interfacial region Y according to the following calculation method, with the use of an energy dispersive X-ray spectroscopic apparatus (EDS) equipped in a scanning electron microscope (SEM) apparatus.

(Measurement of Average Particle Diameter of Filler)

(I) A plurality of measurement samples are collected from a plurality of arbitrary points on the belt.

(II) A part of a cross section of each of the collected measurement samples is cut out with a microtome or the like, and is observed with a scanning electron microscope (SEM) at a specific magnification; and the photograph is obtained. Diameters of the filler in a belt thickness direction and a direction orthogonal to the belt thickness direction are measured from the obtained photograph, and an average value thereof is determined as a particle diameter P of the filler.

(Method for Calculating Average Value A of Ratios of Element Derived from Filler)

(I) A plurality of measurement samples are collected from a plurality of arbitrary points on the belt.

(II) For the collected measurement sample, a cross section in the circumferential direction of the belt, in other words, the cross section including a cross section in a thickness-circumferential direction of the belt is polished with the use of an ion beam, and the cross section for observation is prepared.

(III) For the region Yin the cross section for observation, an element derived from the filler of an arbitrary position is subjected to line analysis using an energy dispersive X-ray spectroscopic apparatus (EDS), and a ratio of the element derived from the filler is obtained for each measurement sample.

(IV) The element ratios at all measurement positions in the measurement sample, which have been obtained in the above (III), are arithmetically averaged, and an average value of the ratios of the element derived from the filler is obtained.

(V) The above operations and analyses of (I) to (IV) are performed on the plurality of measurement samples, and the average value of the ratios of the element derived from the filler is calculated.

(VI) The average value of the ratios of the element derived from the filler in each of the obtained samples is arithmetically averaged, and the average value of the ratios of the element derived from the filler in the region Y is determined.

A more detailed calculation method is as described in Examples.

<Method for Manufacturing Electrophotographic Belt>

One aspect of a method for manufacturing an electrophotographic belt according to one aspect of the present disclosure will be described below.

Firstly, a base body having an endless shape is prepared. For such a base body, a preform having a test tube shape is prepared, for example, with the use of a thermoplastic resin composition containing a thermoplastic polyester resin and a predetermined amount of filler. The preform can be produced with the use of, for example, a pellet of the thermoplastic resin composition and an injection molding method.

Figure 11:
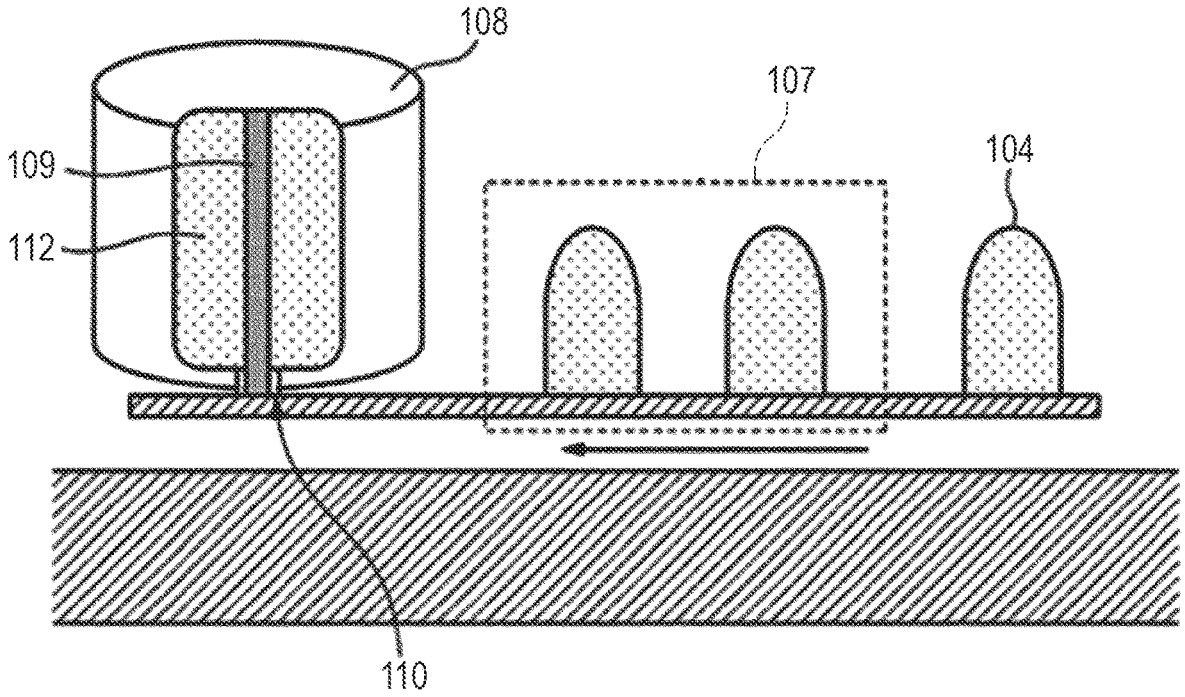
FIG. 11 illustrates a schematic view of a biaxial stretching apparatus used in Examples.

Next, the preform is biaxially stretched with the use of a biaxial stretching apparatus (stretch-blow forming machine) illustrated in FIG. 11. Before biaxial stretching, the preform 104 is placed in a heating apparatus 107 equipped with a non-contact type heater (unillustrated) for heating an outer wall and an inner wall of the preform 104, and is heated by the heater so that the temperature of the outer surface of the preform becomes, for example, 150° C. Next, the heated preform 104 is placed in a blow mold 108 of which the mold temperature is kept at, for example, 30° C., and is stretched in an axial direction with the use of a stretching rod 109. At the same time, air of which the temperature is adjusted to, for example, 23° C. is introduced into the preform 104 from a blow air injection portion 110 to radially stretch the preform 104. In this way, a bottle-shaped formed article 112 is obtained which has been biaxially stretched. Next, the body portion of the obtained bottle-shaped formed article 112 is cut, and a base body of an endless belt is obtained. The base body obtained in this way is stretched in both directions (biaxial stretching) of the circumferential direction and the direction orthogonal to the circumferential direction, and becomes excellent in strength.

However, on the outer peripheral surface of the base body which has been formed by such a method, the filler is exposed, and a salient caused by the filler tends to be easily formed. Accordingly, when the surface layer is formed on the outer peripheral surface of the biaxially stretched base body, which has not been subjected to the surface treatment that will be described later, a large number of fillers can exist in the interfacial region between the surface layer and the base body. As a result, there is a case where the light incident on the outer peripheral surface from the sensor is irregularly reflected, and the amount of regular reflection light decreases that is incident on the light receiving sensor. That is, as to the base body which is biaxially stretched obtained by the aforementioned process, the defect on the outer surface thereof tends to be occur more easily. Thus, in the case that the biaxially stretched base body is used, it is more effective to employ the structure according to the present disclosure.

Figure 12:
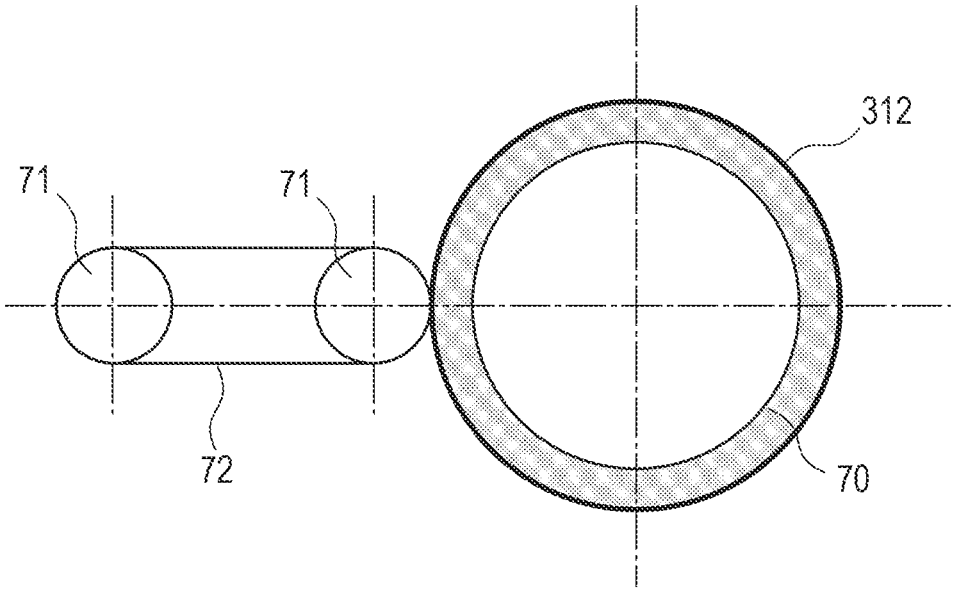
FIG. 12 illustrates a schematic view of an apparatus for removing foreign matter on the surfaces of base bodies used in Examples.

Then, it is preferable to surface-treat the outer peripheral surface of the base body which has been obtained by the above method. Specifically, it is preferable, for example, to make the outer peripheral surface abut on a member such as a nonwoven fabric, a rubber blade or a brush while rotating the base body, and remove the filler that forms the salient on the outer peripheral surface. Specifically, the filler which forms the salient on the outer peripheral surface is removed by pressing the non-woven fabric 72 against the outer peripheral surface of the base body 312 at a predetermined pressure, for example, as illustrated in FIG. 12, and rubbing the outer peripheral surface with the non-woven fabric.

After that, a coating film of paint for forming the surface layer is formed on the outer peripheral surface of the base body, which has been surface-treated, with the use of a known coating method such as dip coating, spray coating, spin coating, ring coating and roll coating. Then, the coating film is cured to form a cured film.

Figure 13:
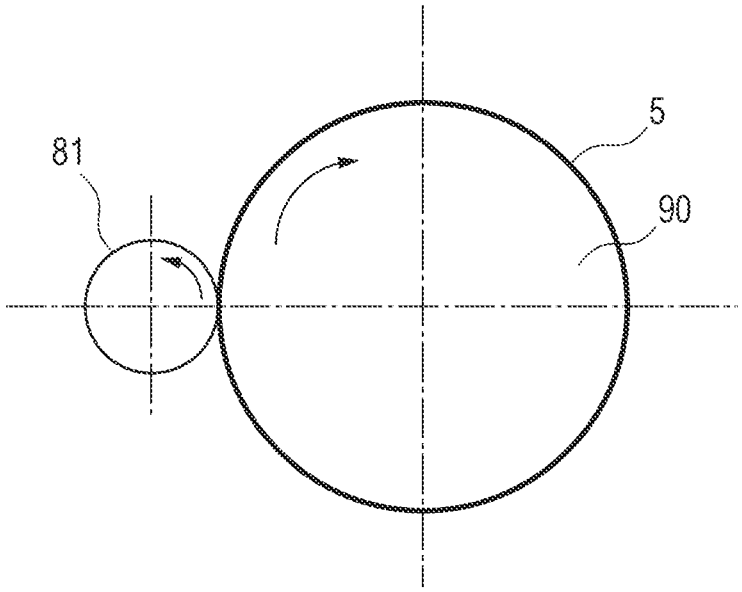
FIG. 13 illustrates a schematic view of an imprint working apparatus used in Examples.

Next, as illustrated in FIG. 13, the base body 5 having the cured film formed thereon is held on an outer peripheral surface of a holding mold 90, and a cylindrical mold 81 is arranged against the holding mold 90 so that the rotation axes of the holding mold 90 and the cylindrical mold 81 become parallel to each other, and also, the outer peripheral surface of the cylindrical mold comes in contact with the outer surface of the cured film. A salient is formed on the outer peripheral surface of the cylindrical mold, which has a shape corresponding to the shape of the groove that should be formed in the outer peripheral surface of the surface layer. Then, the salient is pressed against the cured film while the holding mold and the cylindrical mold are rotated at a predetermined speed, and thereby the groove is transferred to the surface of the cured film, which extends in the circumferential direction of the base body.

<Electrophotographic Image Forming Apparatus>

Figure 5:
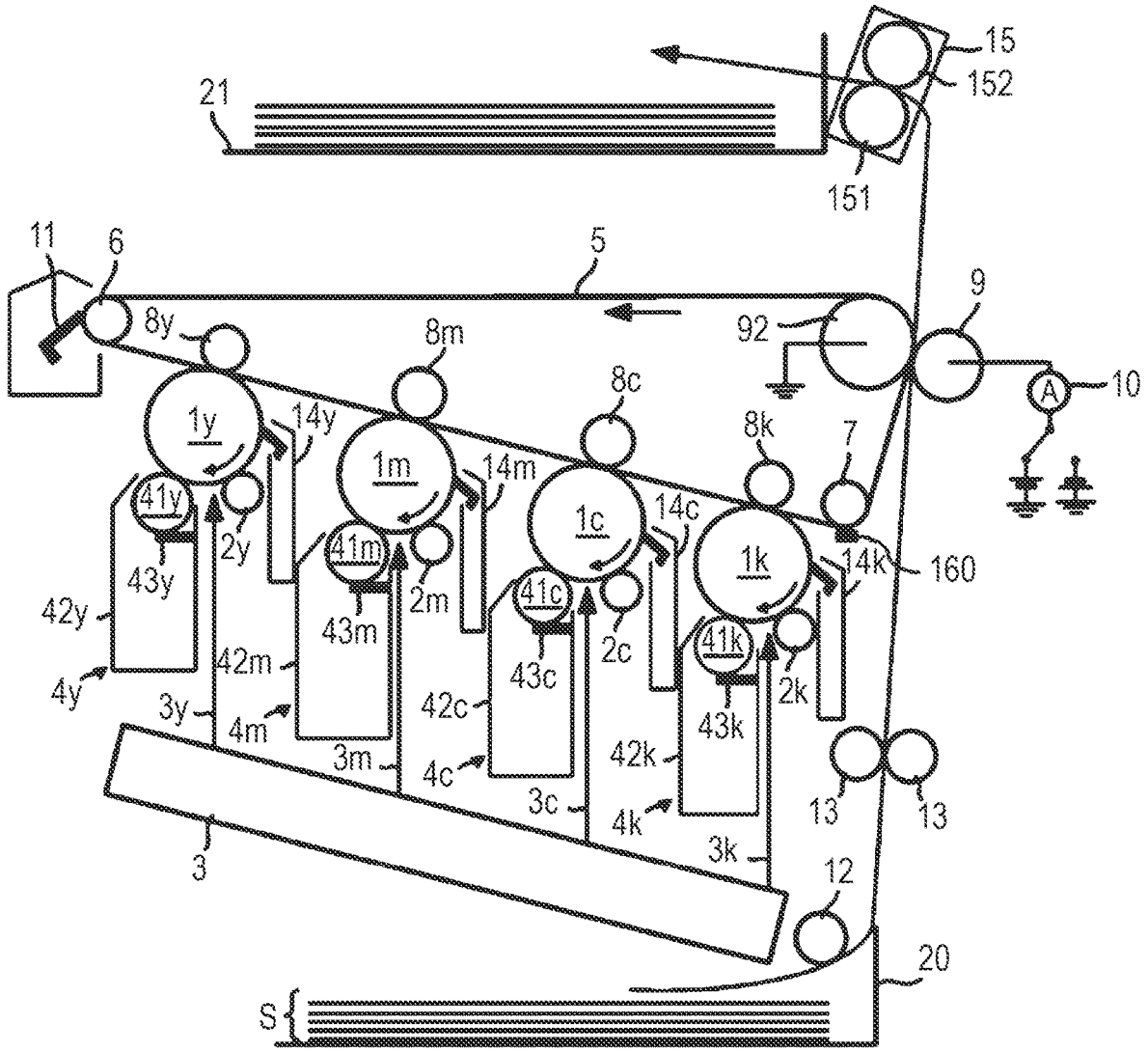
FIG. 5 illustrates a schematic view illustrating one example of a configuration of an image forming apparatus of an intermediate transfer method.

FIG. 5 illustrates one example of an electrophotographic apparatus that has an electrophotographic belt according to one aspect of the present disclosure, as an intermediate transfer belt. This electrophotographic apparatus forms a color image on a recording medium S such as paper supplied from a paper feed cassette 20, with the use of toners of four colors which are represented by yellow (Y), magenta (M), cyan (C) and black (K), respectively. An image forming station of each of the colors is arranged in an approximately horizontal direction. Photosensitive drums 1*y*, 1*m*, 1*c* and 1*k* are provided in these image forming stations, respectively. Here, "y", "m", "c" or "k" is attached as a suffix to the reference numeral, and thereby indicates that which color image forming station, the member having the reference numeral attached thereto belongs to. A laser scanner 3 which is a laser optical unit is provided in the image forming apparatus, and laser beams 3*y*, 3*m*, 3*c* and 3*k* corresponding to image signals of respective colors are emitted therefrom toward photosensitive drums 1*y*, 1*m*, 1*c* and 1*k*, respectively. Any of the image forming stations has the same structure, and accordingly, an image forming station for the K color will be described here. The photosensitive drum 1*k* is arranged so as to be surrounded by an electroconductive roller 2*k* that is a contact charging apparatus, a developing device 4*k*, an electroconductive roller 8*k* that is a primary transfer roller, and a toner collecting blade 14*k* that is used for cleaning of the photosensitive drum 1*k*. The developing device 4*k* is provided with a developing roller 41*k* that is a carrying body of a developer which develops a latent image on the photosensitive drum 1*k*, a developing vessel 42*k* that holds toner to be supplied to the developing roller 41*k*, and a developing blade 43*k* that regulates the amount of the toner on the developing roller 41 and imparts an electric charge to the toner.

The electrophotographic belt (intermediate transfer belt) 5 is configured as a belt having an endless shape, and is commonly provided on image forming stations of the respective colors. The intermediate transfer belt 5 is bridged over a secondary transfer facing roller 92, a tension roller 6 and a driving roller 7, and is rotated by the driving roller 7 in a direction indicated by the arrow in the figure. The intermediate transfer belt 5 sequentially abuts on the surfaces of the photosensitive drums 1*y*, 1*m*, 1*c* and 1*k* in a zone between the tension roller 6 and the driving roller 7, and is pressed toward the photosensitive drums 1*y*, 1*m*, 1*c* and 1*k*, by primary transfer rollers 8*y*, 8*m*, 8*c* and 8*k*, respectively. Thereby, the toner images formed on the surfaces of the photosensitive drums 1*y*, 1*m*, 1*c* and 1*k* result in being transferred to the surface of the intermediate transfer belt 5. A secondary transfer roller 9 is provided so as to face the secondary transfer facing roller 92, and the intermediate transfer belt 5 is pressed toward the facing roller 92 by the secondary transfer roller 9. A secondary transfer voltage is applied to the secondary transfer roller 9 from a power source via a current detection circuit 10. A secondary transfer portion is composed of the secondary transfer roller 9 and the facing roller 92. The recording medium S passes through a feeding roller 12 and a conveying roller 13, and then a nip portion between the intermediate transfer belt 5 and the secondary transfer roller 9, at a position of the facing roller 92; and thereby the toner image retained on the outer peripheral surface of the intermediate transfer belt 5 is transferred to the recording medium S. Thereby, an image is formed on the surface of the recording medium S. The recording medium S onto which the toner image has been transferred passes through a fixing device 15 that includes a pair of rollers of a heating roller 151 and a pressure roller 152, thereby the image is fixed on the recording medium S, and the resultant recording medium S is discharged onto a discharge tray 21. A cleaning blade 11 that abuts on the outer peripheral surface of the intermediate transfer belt 5 is provided at a position of the tension roller 6. The toner that remains on the outer peripheral surface of the intermediate transfer belt 5 without being transferred to the recording medium S is scraped off by the cleaning blade 11 and removed. The cleaning blade 11 is a member which extends in a direction approximately orthogonal to a moving direction of the intermediate transfer belt 5.

A material for the cleaning blade 11 is not particularly limited as long as the material is suitable for cleaning of the toner; examples thereof include urethane rubber, acrylic rubber, nitrile rubber, and EPDM rubber; and the urethane rubber is preferable from the viewpoint of the cleaning of the toner.

In an image forming apparatus, a color tone of a printed matter changes depending on conditions such as a use environment. Because of this, it is necessary to appropriately measure the density and to feed back the measured density to a control mechanism in the main body. The toner image for density correction is transferred onto the surface of the intermediate transfer belt 5, and then is conveyed to a position of the driving roller 7 as the intermediate transfer belt 5 rotates. The toner density is detected by a density detection sensor 160 which is arranged on the opposite side of the driving roller 7 across the intermediate transfer belt 5.

Figure 6:
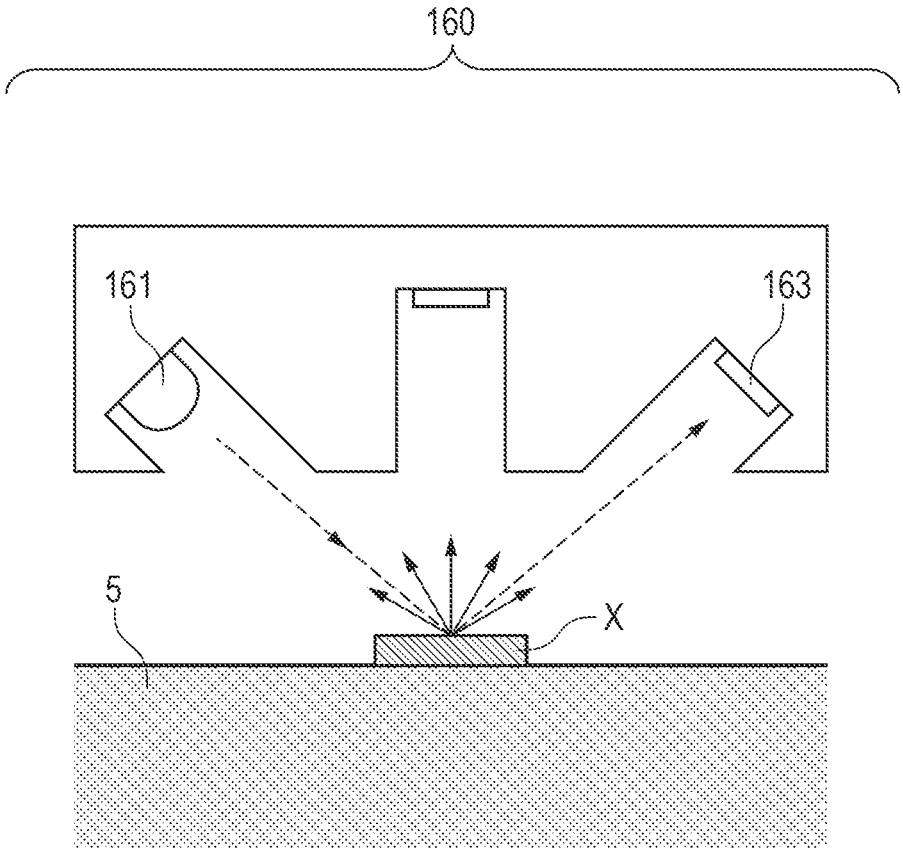
FIG. 6 illustrates a schematic view illustrating one example of a configuration of a density detection sensor.

FIG. 6 is a schematic configuration diagram of the density detection sensor 160 which is an optical sensor. The density detection sensor 160 includes a light emitting element 161 and a light receiving element 163 for detecting regular reflection. The light emitting element 161 emits infrared light, and the light is reflected on the surface of a toner image for correction (hereinafter, also simply referred to as a "toner image") X. The light receiving element 163 is arranged in a direction of regular reflection with respect to the position of the toner image X, and detects the light regularly reflected at the position of the toner image X.

Figure 7:
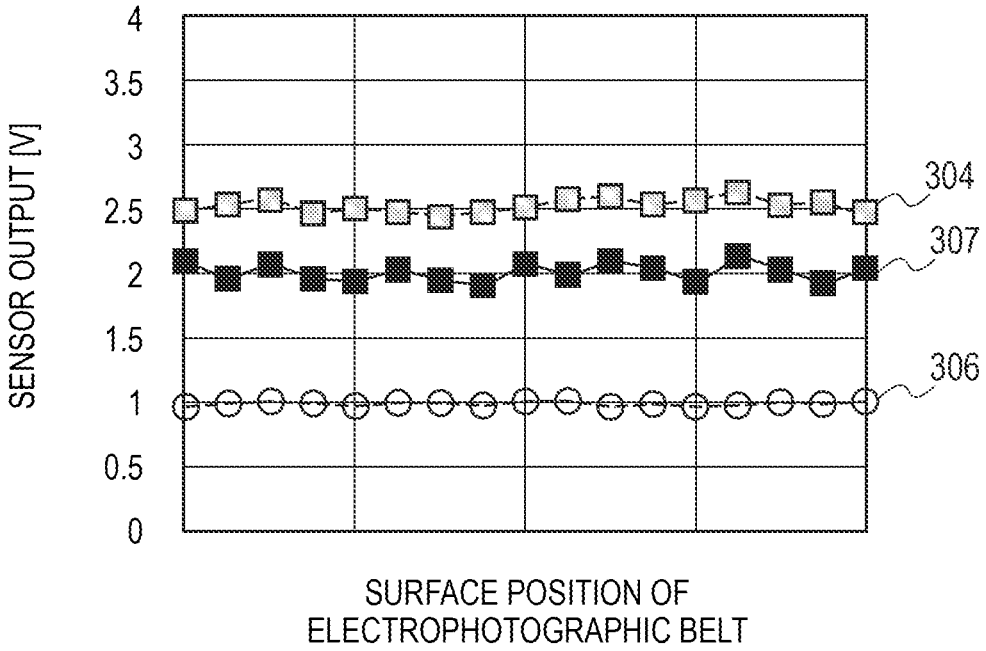
FIG. 7 illustrates a graph illustrating one example of respective outputs from a sensor that has received regular reflection light from surfaces of an electrophotographic belt according to one aspect of the present disclosure and of an electrophotographic belt having no groove thereon.

FIG. 7 illustrates a graph illustrating outputs 307 of the substrate at a plurality of positions of the endless belt according to the present disclosure, by the density detection sensor, and outputs 306 of the sensor that has received the reflected light from the toner image at the positions. In FIG. 7, for comparison, the outputs 304 of the sensor are also illustrated that has received the reflected light from the non-toner image portion, at a plurality of positions on the belt of which the surface is smooth. As is illustrated in FIG. 7, in the output 307 from the non-toner image portion of the endless belt 5 according to the present disclosure, the output value is lower than that of the output 304 of the substrate of the belt of which the surface is smooth. However, the fluctuation of the outputs 307 depending on the position is small, and has a large difference from the outputs 306, and accordingly, the density of the toner image can be accurately detected.

According to one aspect of the present disclosure, an electrophotographic belt can be obtained that has a plurality of grooves on an outer peripheral surface, and provides a stable amount of light reflected from the outer peripheral surface. According to another aspect of the present disclosure, an electrophotographic image forming apparatus can be obtained that can stably form a high-quality electrophotographic image.

EXAMPLES

The electrophotographic belt according to the present disclosure will be described in detail with reference to Examples and Comparative Examples below, but the electrophotographic belt according to the present disclosure is not limited to configurations embodied in these Examples.

As materials to be used for manufacturing the electrophotographic belt according to Examples and Comparative Examples, thermoplastic resin compositions described in the following Table 1 and acrylic resin compositions described in Table 2 were prepared.

TABLE 1

| <Thermoplastic resin composition> | |
|---|---|
| Polyester resin 1 | Polyethylene terephthalate (Trade name: TRN-8550FF, produced by Teijin Limited) |
| Polyester resin 2 | Polyethylene naphthalate (Trade name: TN-8050SC, produced by Teijin Limited) |
| CB | Carbon black (Trade name: MA-100, produced by Mitsubishi Chemical Corporation) |
| Electroconductive agent | N,N,N-trioctyl-N-methylammonium-bis (trifluoromethanesulfonyl)imide (Trade name: MTOA-TFSI, produced by Toyo Gosei Co., Ltd.) |
| Filler 1 | Spherical silica (Trade name: SO-C2, produced by Admatechs Company Limited) Average particle diameter: 0.5 μm |
| Filler 2 | Spherical silica (Trade name: SO-C6, produced by Admatechs Company Limited) Particle diameter: 2.1 μm |
| Filler 3 | Spherical silicone particle (Trade name: Tospearl 120, produced by Momentive Performance Materials Japan LLC) Particle diameter: 2.0 μm |
| Filler 4 | Spherical alumina (Trade name: Alunabeads CB-P02, produced by Showa Denko K. K.) Particle diameter: 2.0 μm |
| Filler 5 | Spherical crosslinked acrylic polymer particle (Trade name: ENEOS Uni-Powder NMB-0320C, produced by ENEOS Liquid Crystal Co., Ltd.) Particle diameter: 3.0 μm |

TABLE 2

| <Acrylic resin composition> | |
|---|---|
| AN | Dipentaerythritol penta and hexa-acrylate (Trade name: Aronix M-402, produced by Toagosei Co., Ltd.) |
| PTFE | PTFE particle (Trade name: LUBRON L-2, produced by Daikin Industries, Ltd.) |
| GF | PTFE particle dispersant (Trade name: GF-300, produced by Toagosei Co., Ltd.) |
| SL | Slurry of zinc antimonate particle (Trade name: CELNAX CX-Z400K, produced by Nissan Chemical Corporation, 40% by mass as component of zinc antimonate particle) |
| IRG | Photopolymerization initiator (Trade name: lrgacure 907, produced by BASF) |

(Methods for Measuring and Evaluating Characteristic Values)

Methods for measuring and evaluating characteristic values of electrophotographic belts according to Examples and Comparative Examples are as in the following (1) to (5).

(1) Evaluation of Average Particle Diameter P of Filler

The average particle diameter P of the filler was evaluated by the following method. Firstly, measurement samples were cut out from arbitrary 20 points of an obtained electrophotographic belt, which had each a size of longitudinally 5 mm, long transversely 5 mm and short transversely the entire thickness of the transfer belt.

A part of the cross section of each of the obtained measurement samples was further cut out with a microtome or the like, and was observed with an FE-SEM (trade name: Sigma500VP, manufactured by Carl Zeiss Microscopy Co., Ltd.) at a magnification of 5000 times; and the image (photograph) was obtained. In addition, each of the samples was subjected to element analysis using EDX (Energy Dispersive X-ray Spectroscopy), and an element contained in the filler was identified. Furthermore, from the obtained image, the diameters of the filler in a thickness direction of the belt and a direction orthogonal to the thickness direction of the belt were measured, and the arithmetic average value thereof was regarded as the particle diameter of the filler.

For each of at least 200 or more fillers, the particle diameter was similarly measured, and the average value of the particle diameters of the top 50 of the measured particle diameters was defined as the average particle diameter P of the filler.

(2) Measurement of Content of Filler in Base Body

A total of 100 measurement samples were cut out from arbitrary 20 points in the circumferential direction of an obtained endless belt, which had each a size of longitudinally 5 mm, long transversely 5 mm and short transversely the entire thickness of the transfer belt. For each of the 100 measurement samples, a cross section in the circumferential direction of the transfer belt, in other words, a cross section including a first cross section in the thickness-circumferential direction of the base material was polished. For polishing, a cross section polisher (trade name: SM09010, manufactured by JEOL Ltd.,) was used. As for the polishing conditions, the cross section was irradiated with an ion beam at an applied voltage of 4.5 V, in an argon gas atmosphere for 11 hours. Next, the polished cross section was made electroconductive by having a gold-palladium film formed thereon, and thus, a cross section for observation was formed. The gold-palladium film was formed by sputter coating with the use of a sputter coater (trade name: 108Auto Sputter Coater; manufactured by Cressington Scientific Instruments Ltd.) at 30 mA, for 20 seconds. The cross section for observation was subjected to secondary-electron image observation with the use of an FE-SEM (trade name: Sigma 500VP, manufactured by Carl Zeiss Microscopy Co., Ltd.) under conditions of an acceleration voltage of 10 kV, a spot size of 60 μm, an observation magnification of 1000 times, and WD of 8.5 mm.

Figure 8:
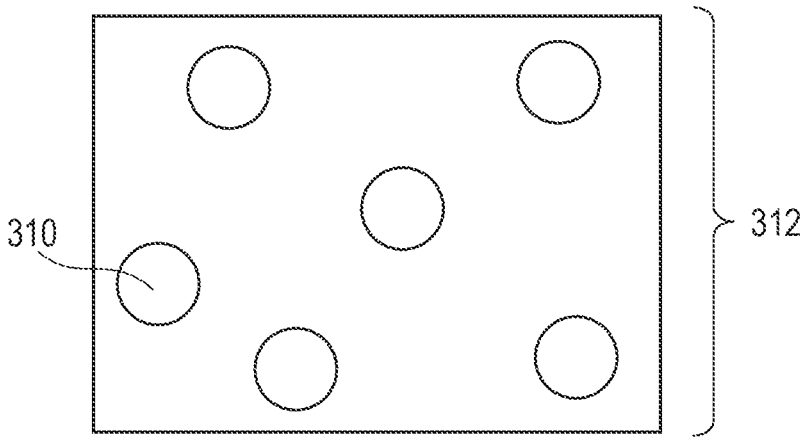
FIG. 8 illustrates a schematic cross-sectional view of a base body of an electrophotographic belt according to one aspect of the present disclosure.

As is illustrated in FIG. 8, the observation point was adjusted so that only the base body portion of the endless belt was included in the field of view. An SEM image to be used for the EDS analysis was determined, and the ratio of the element derived from the filler (silica particle in Example 1) in the field of view was measured, and was defined as a content (% by volume) of the filler in the base body. An energy dispersive X-ray spectroscopic apparatus (EDS) (trade name: X-MAXN80, manufactured by Oxford Instruments K.K.) was used for the measurement of the element ratio.

(3) Measurement of Ratio of Element Derived from Filler in Interfacial Region Between Base Body and Surface Layer As is illustrated in FIG. 9A and FIG. 9B, with the use of the measurement sample cut out in the above (2), the observation point was adjusted so that the interface (first surface B1) between the base body and the surface layer of the electrophotographic belt was included in the upper part of the screen in the field of view, and an SEM image to be used for the EDS analysis was determined.

Figure 10:
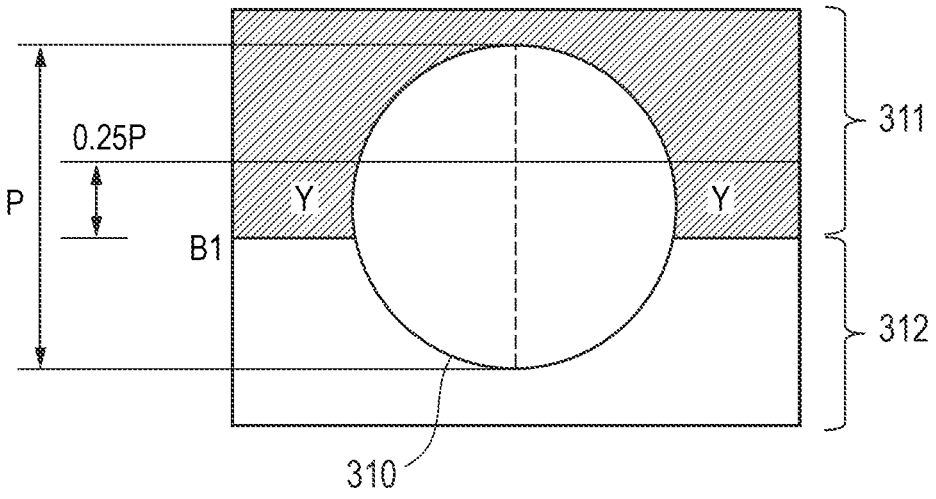
FIG. 10 illustrates a schematic cross-sectional view describing a position of 0.25P from the first surface B1.

Subsequently, as is illustrated in FIG. 10, the ratio of the element derived from the filler (Si in silica particle in Example 1) in the region Y was measured. An energy dispersive X-ray spectroscopic apparatus (EDS) (trade name: X-MAXN80, manufactured by Oxford Instruments K.K.) was used for the measurement of the element ratio.

Note that, here, 300 measurement points of the produced electrophotographic belt were arbitrarily selected.

Firstly, an image of the obtained SEM image was captured as an EDS analysis region.

Then, as is illustrated in FIG. 10, in the field of view of the obtained SEM image, the ratio of the element derived from the filler was measured by the line analysis corresponding to arbitrarily selected 300 points of L1 to L300 at least in the region Y, in a direction parallel to the first surface B1.

As for the analysis conditions, the measurement was performed with a line analysis mode, and with the number of scans of 4 times, and the pixel dwell time of 5 ms, in the EDS acquisition line data setting. Thus, the ratio of the element derived from the filler was obtained at 300 selected points.

Then, the measurement results obtained at each of the points were averaged at all measurement positions (300 points), and an average value of the element ratio in the region Y was obtained. For information, gold and palladium elements are elements derived from the electroconductive treatment, and are not elements derived from the electrophotographic belt; and accordingly were excluded from an object of the analysis.

The element ratio of the filler in the region Y was approximately 0 atomic % or higher and 1.0 atomic % or lower.

(4) Evaluation of Tensile Elastic Modulus

The tensile elastic modulus was measured with the use of a universal material testing machine for low load (trade name: 34TM-5, manufactured by Instron Corporation) in which a load cell of 5 kN was incorporated, in an environment at a temperature of 23° C. and a relative humidity of 50%. Sample pieces of 100 mm in the circumferential direction of the belt×20 mm in the longitudinal direction, and 20 mm in the circumferential direction of the belt×100 mm in the longitudinal direction were cut out from the produced electrophotographic belt, and the sample piece was gripped by a pneumatic grip of which the distance between the chucks was set to 50 mm. The gripped sample piece was pulled at a constant speed of 5 mm/min, and from the obtained stress-strain curve and the thickness of the electrophotographic belt, the elastic modulus was calculated based on the stress value at 0.25% strain. Average values were determined from the measurement results of each of five sample pieces cut out from the same electrophotographic belt, and the average values were defined as a tensile elastic modulus Ep in the circumferential direction and a tensile elastic modulus Ea in the direction orthogonal to the circumferential direction of the electrophotographic belt, respectively.

(5) Evaluation of Amount of Reflected Light

Endless belts manufactured in Examples or Comparative Examples which would be described later were each mounted on the image forming apparatus for electrophotography having a configuration illustrated in FIG. 5, as an intermediate transfer belt. The regular reflection output per circumference of the endless belt was measured at intervals of 1 mm, and an average value $V_{ave}$, the maximum value $V_{max}$ and the minimum value $V_{min}$ of the measured outputs, and a fluctuation ratio obtained from the following expression (1) were evaluated.

For information, the density detection sensor is arranged at a position of ±100 mm from the center in the width direction of the electrophotographic belt. In addition, the regular reflection output varies depending on the conditions of the grooves provided on the surface of the electrophotographic belt; and accordingly, in the present evaluation, the output of the light amount was adjusted so that the regular reflection output became 3.0 V, and the regular reflection output was measured.

$$\text{Fluctuation ratio}=(V_{max}-V_{min})/V_{ave} \qquad \text{Expression (1)}$$

Examples 1 to 10

(Manufacture of Base Body)

Materials were preblended in advance according to the formulation shown in Table 3, then the blend was hot-melt kneaded by use of a twin-screw extruder (trade name: TEX30a, manufactured by Japan Steel Works, Ltd.), and a thermoplastic resin composition was prepared. The hot-melt kneading temperature was adjusted to become within a range of 270° C. or higher and 300° C. or lower, and a hot-melt kneading period of time was set to approximately 3 to 5 minutes. The obtained thermoplastic resin composition was pelletized, and was dried at a temperature of 140° C. for 6 hours. Next, the dried pellet-shaped thermoplastic resin composition was charged into an injection molding apparatus (trade name: SE180D, manufactured by Sumitomo Heavy Industries Ltd.). Then, a set temperature of the cylinder was set to 300° C., the charged thermoplastic resin composition was injection molded into a mold of which the temperature was adjusted to 30° C., and a preform was prepared. The obtained preform had a shape of a test tube of which the outer diameter was 50 mm, the inner diameter was 46 mm, and the length was 100 mm.

Next, the above preform is biaxially stretched with the use of a biaxial stretching apparatus (stretch-blow forming machine) illustrated in FIG. 11. Before biaxial stretching, the preform 104 was placed in a heating apparatus 107 which was equipped with a non-contact type heater (unillustrated) for heating an outer wall and an inner wall of the preform 104, and was heated by the heater so that the temperature of the outer surface of the preform became 150° C.

Next, the heated preform 104 was placed in a blow mold 108 of which the mold temperature was kept at 30° C., and was stretched in an axial direction with the use of a stretching rod 109. At the same time, air of which the temperature is adjusted to a temperature of 23° C. was introduced into the preform 104 from a blow air injection portion 110 to radially stretch the preform 104. Thus, a bottle-shaped formed article 112 was obtained.

Next, the body portion of the obtained bottle-shaped formed article 112 is cut, and a base body of an electrophotographic belt was obtained. The peripheral length of the base body was 680 mm and the width was 250 mm.

(Surface Treatment of Outer Peripheral Surface of Base Body)

The base body of the obtained electrophotographic belt was pressed against a cleaning cloth (trade name: Toraysee MK (industrial); produced by Toray Industries, Inc.) and was surface-treated so that the filler was removed which was exposed to the outer peripheral surface of the base body and formed the salient on the outer peripheral surface. Specifically, as illustrated in FIG. 12, the base body 312 of the electrophotographic belt was held on the outer peripheral surface of a cylindrical holding mold 70, and the cleaning cloth 72 that was stretched over sheet driving rollers 71 was pressed against the base body 312 by a pressing force of 0.5

MPa. In this state, the cylindrical holding mold 70 was rotated at 1 rpm. In addition, the cleaning cloth was rotated at 0.1 rpm. Thus, the outer peripheral surface of the base body was surface-treated, and the filler was removed that formed the salient on the outer peripheral surface. The surface of the cleaning cloth after the treatment was observed with an FE-SEM and subjected to an elemental analysis with an energy dispersive X-ray spectroscopic apparatus (EDS), and as a result, an element (silicon atom) derived from the filler was detected.

(Preparation of Coating Liquid)

Each material shown in Table 2 was weighed at a ratio of AN/PTFE/GF/SL/IRG=66/20/1.0/12/1.0 (weight ratio in terms of solid content), and was subjected to coarse dispersion treatment. A solution after the coarse dispersion treatment was subjected to main dispersion treatment with the use of a high-pressure emulsifying disperser (trade name: Nanovater, manufactured by Yoshida Kikai Co., Ltd.), and a coating liquid containing an acrylic resin composition was obtained. The main dispersion treatment was carried out until the 50% average particle diameter of the contained PTFE reached 200 nm.

(Formation of Surface Layer)

The biaxially stretched base body was fitted to the outer periphery of a cylindrical mold (peripheral length of 680 mm), and the ends were sealed; and besides, the resultant mold was immersed together with the base body in a vessel filled with the coating liquid. The base body was raised so that the relative speed between the liquid surface of the coating liquid and the base body became constant, and thereby a coating film was formed on the surface of the base body, which was formed from the coating liquid. The raising speed (relative speed between liquid surface of coating liquid and base body) and a solvent ratio in the coating liquid can be adjusted according to a required film thickness. In the present Example, the raising speed was set to 10 to 50 mm/sec, and the film thickness of the coating film was adjusted so as to satisfy the desired thickness of the surface layer after curing. In the present Example, the application direction refers to a direction opposite to the direction in which the base body is raised. In other words, the place which is firstly raised from the coating liquid becomes the uppermost stream. The base body to which the coating liquid was applied was removed from the cylindrical mold, and was dried for 1 minute in an environment at a temperature of 23° C., under exhaust ventilation. The drying temperature and drying time are appropriately adjusted according to a solvent type, the solvent ratio, and the film thickness. After that, the coating film was irradiated with ultraviolet rays by use of a UV irradiation machine (trade name: UE06/81-3, manufactured by Eye Graphics Co., Ltd.) until the integrated light quantity reached 600 mJ/cm$^2$, and thereby the coating film was cured. The thickness of the surface layer was measured by such a destructive test as to cut an electrophotographic belt which was separately prepared under the same conditions and observe the cross section with an electron microscope (trade name: XL30-SFEG, manufactured by FEI Company Japan Ltd.). As a result of the destructive test, the thickness of the surface layer was 3.0 μm.

(Formation of Groove)

A groove was formed on the endless belt 5 which retained the surface layer after curing thereon, with the use of an imprint working apparatus illustrated in FIG. 13.

Figure 14:
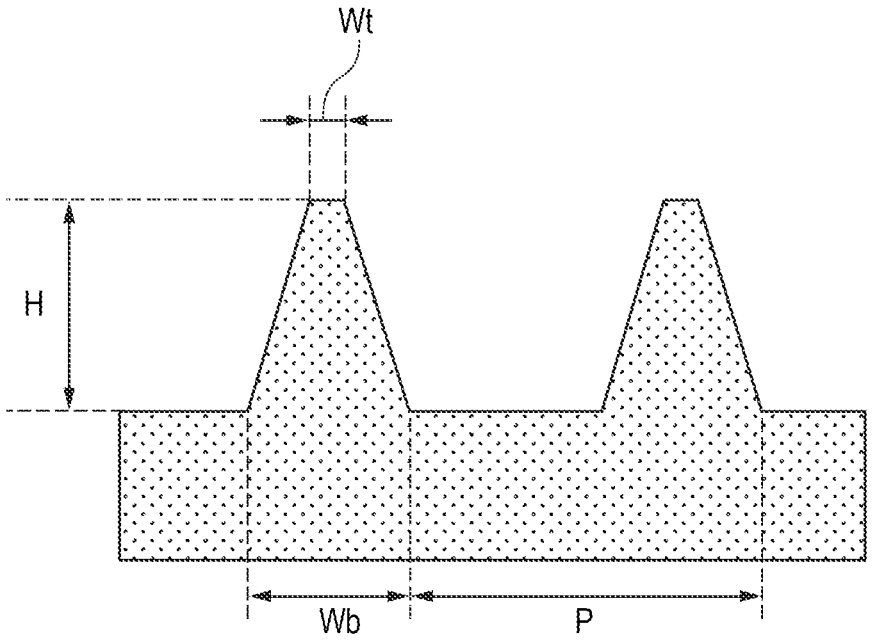
FIG. 14 illustrates a schematic cross-sectional view of a cylindrical mold used in Examples.

The imprint working apparatus includes a cylindrical mold 81 and a cylindrical belt holding mold 90, and the cylindrical mold 81 can apply pressure to the cylindrical belt holding mold 90 in a state of keeping its axis parallel to that of the cylindrical belt holding mold 90. At this time, the cylindrical mold 81 and the cylindrical belt holding mold 90 rotate synchronously without causing a slip. The cylindrical mold 81 is a mold that is formed from carbon steel plated with electroless nickel, and has a diameter of 50 mm and a length of 250 mm. A fine salient shape was formed on the surface of the cylindrical mold 81, and the salient pattern was formed in a spiral shape at an angle of 0.1° with respect to the circumferential direction of the cylindrical mold. The salient pattern of the cylindrical mold 81 used in the present Example had a shape illustrated in FIG. 14, and the respective dimensions were H=3.5 μm, Wb=2.0 μm, Wt=0.2 μm, and P=20 μm. The cylindrical mold 81 had a structure in which an unillustrated cartridge heater was embedded so as to be capable of heating.

Next, the base body on which the coating film was formed is fitted in advance to the outer periphery of the cylindrical belt holding mold 90 (peripheral length of 680 mm). The cylindrical belt holding mold 90 and the cylindrical mold 81 were rotated at a peripheral speed of 1 mm/sec (rotation directions were opposite to each other), and the cylindrical mold 81 heated to 130° C. was brought into contact with the holding mold 90 while keeping the center lines of the axes parallel to each other, and pressurized the holding mold 90 to 8.0 kN at a rate of 1.0 kN/s. After that, in such a state that the pressing force was maintained at 8.0 kN, the cylindrical belt holding mold 90 and the groove imparting cylindrical mold 81 were rotated, and the groove imparting cylindrical mold 81 was released at the timing when the imprint working corresponding to one circumference of the belt was completed. Thereby, the salient shape of the groove imparting cylindrical mold 81 was transferred to the surface of the surface layer of the electrophotographic belt.

In the groove pattern of the electrophotographic belt obtained by the above process, the number of grooves was 12200; and the width and depth of the grooves were W1=0.6 μm, H1=0.6 μm, and P1=20 μm, respectively.

The electrophotographic belt was mounted on the electrophotographic image forming apparatus illustrated in FIG. 5, and the regular reflection output was evaluated; and as a result, it was confirmed that the fluctuation ratios were all as very small as 25% or smaller.

TABLE 3

<Examples 1 to 10>

| | Example | | | | | | | | | |
|---|---|---|---|---|---|---|---|---|---|---|
| | 1 | 2 | 3 | 4 | 5 | 6 | 7 | 8 | 9 | 10 |
| Polyester resin 1 [% by mass] | 97.9 | 96.3 | 95.3 | 93.2 | | | | | | 16.3 |
| Polyester resin 2 [% by mass] | | | | | 98.3 | 97.3 | 95.3 | 93.3 | 88.2 | 80.0 |
| Filler 1 [% by mass] | 0.5 | | | | | | | | 8.0 | |
| Filler 2 [% by mass] | | 2.0 | | | | | | 5.0 | | |

TABLE 3-continued

<Examples 1 to 10>

| | Example | | | | | | | | | |
|---|---|---|---|---|---|---|---|---|---|---|
| | 1 | 2 | 3 | 4 | 5 | 6 | 7 | 8 | 9 | 10 |
| Filler 3 [% by mass] | | | 3.0 | | | | 3.0 | | 2.0 | 2.0 |
| Filler 4 [% by mass] | | | | 5.0 | | 1.0 | | | | |
| Filler 5 [% by mass] | | | | | 0.1 | | | | | |
| Electroconductive agent [% by mass] | 1.5 | 1.5 | 1.5 | 1.5 | 1.5 | 1.5 | 1.5 | 1.5 | 1.5 | 1.5 |
| CB [% by mass] | 0.1 | 0.2 | 0.2 | 0.3 | 0.1 | 0.2 | 0.2 | 0.2 | 0.3 | 0.2 |
| Presence or absence of surface treatment for base body | Present | Present | Present | Present | Present | Present | Present | Present | Present | Present |
| Thickness T of base body [μm] | 60.2 | 62.8 | 68.3 | 65.2 | 64.0 | 70.1 | 61.5 | 58.9 | 72.2 | 64.8 |
| Average particle diameter P of filler [μm] | 0.48 | 2.06 | 1.98 | 1.97 | 2.89 | 1.96 | 1.98 | 2.05 | 0.56 | 1.93 |
| Content of filler [% by volume] | 0.50 | 1.92 | 2.85 | 4.68 | 0.09 | 0.95 | 2.91 | 4.88 | 9.62 | 1.95 |
| Ratio A of element derived from filler in interfacial region [atomic %] | 0.21 | 0.64 | 0.69 | 0.77 | 0.05 | 0.64 | 0.72 | 0.83 | 0.96 | 0.70 |
| Elastic modulus Ep[MPa] | 1304 | 1255 | 1316 | 1352 | 1685 | 1722 | 1852 | 1987 | 2051 | 1523 |
| Elastic modulus Ea[MPa] | 1239 | 1215 | 1246 | 1278 | 1624 | 1685 | 1743 | 1859 | 1955 | 1494 |
| Average regular reflection output [V] | 1.85 | 1.98 | 2.15 | 2.26 | 1.76 | 1.87 | 1.98 | 2.03 | 2.14 | 1.95 |
| Fluctuation ratio of regular reflection [%] | 18.2 | 21.4 | 23.6 | 24.1 | 17.3 | 18.6 | 20.3 | 24.6 | 24.8 | 23.5 |

Comparative Examples 1 to 5

Electrophotographic belts were produced in the same manner as in Example 1, except that the types and amounts of materials, and presence or absence of cleaning for the base body were set as described in the following Table 4. These evaluation results are shown in Table 4.

TABLE 4

<Comparative Examples 1 to 5>

| | Comparative Example | | | | |
|---|---|---|---|---|---|
| | 1 | 2 | 3 | 4 | 5 |
| Polyester resin 1 [% by mass] | 98.3 | 84.3 | — | — | — |
| Polyester resin 2 [% by mass] | — | — | 96.3 | 95.3 | 90.3 |
| Filler 1 [% by mass] | 0.05 | — | — | — | — |
| Filler 2 [% by mass] | — | — | 2.0 | — | — |
| Filler 3 [% by mass] | — | — | — | 3.0 | — |
| Filler 4 [% by mass] | — | — | — | — | 8.0 |
| Filler 5 [% by mass] | — | 14.0 | — | — | — |
| Electroconductive agent [% by mass] | 1.5 | 1.5 | 1.5 | 1.5 | 1.5 |
| CB [% by mass] | 0.2 | 0.2 | 0.2 | 0.2 | 0.2 |
| Presence or absence of cleaning for base body | Present | Present | Absent | Absent | Absent |
| Thickness T of base body [μm] | 59.2 | 62.9 | 62.3 | 60.5 | 70.8 |
| Average particle diameter P of filler [μm] | 0.45 | 2.86 | 2.03 | 1.96 | 0.47 |
| Content of filler [% by volume] | 0.05 | 13.20 | 1.95 | 2.77 | 7.69 |
| Ratio A of element derived from filler in interfacial region [atomic %] | 0.02 | 1.33 | 1.74 | 2.38 | 7.02 |
| Elastic modulus Ep[MPa] | 1252 | 1289 | 1854 | 1789 | 1925 |
| Elastic modulus Ea[MPa] | 1208 | 1236 | 1759 | 1726 | 1879 |
| Average regular reflection output [V] | 1.33 | 2.23 | 1.85 | 2.01 | 2.18 |
| Fluctuation ratio of regular reflection [%] | 45.8 | 53.8 | 50.9 | 54.6 | 57.9 |

In Comparative Example 1, the content of the filler was small and a sufficient regular reflection output was not obtained; and the fluctuation ratio with respect to the average regular reflection output resulted in being large. In Comparative Example 2, because the content of the filler was large, the average regular reflection output became large, but the amount of the filler in the 0.25P region also became large, and the irregular reflection light increased; and as a result, the fluctuation ratio with respect to the average regular reflection output resulted in being large. In Comparative Examples 3 to 5, because the base body was not cleaned, the amount of the filler in the 0.25P region also increased, and the irregular reflection light increased; and as a result, the fluctuation ratio with respect to the average regular reflection output resulted in being large.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-050144, filed Mar. 24, 2021, and Japanese Patent Application No. 2022-040164, filed Mar. 15, 2022, which are hereby incorporated by reference herein in their entirety.

What is claimed is:

1. An electrophotographic belt having an endless shape, comprising:

a base body having an endless shape; and a surface layer on an outer peripheral surface of the base body, wherein grooves extending in a circumferential direction are provided on an outer surface of the surface layer;

the base body contains a thermoplastic polyester resin and a filler;

the surface layer contains an acrylic resin;

a thickness T of the base body is 30 μm or larger, and a content of the filler in the base body is 0.1% by volume to 10.0% by volume based on a total volume of the base body; and in a region having a thickness 0.25 times as thick as an average particle diameter of the filler, from a first surface of the surface layer on a side facing the base body, toward a second surface of the surface layer, the second surface being opposite to the first surface, an average value A of ratios of elements derived from the filler is 0.0 atomic % to 1.0 atomic %.

2. The electrophotographic belt according to claim 1, wherein the base body is stretched in the circumferential direction and a direction orthogonal to the circumferential direction.

3. The electrophotographic belt according to claim 1, wherein a tensile elastic modulus Ep in the circumferential direction and a tensile elastic modulus Ea in a direction orthogonal to the circumferential direction of the electrophotographic belt are both 1200 MPa or larger.

4. The electrophotographic belt according to claim 1, wherein the thermoplastic polyester resin comprises at least one selected from the group consisting of polyalkylene terephthalate and polyalkylene naphthalate.

5. The electrophotographic belt according to claim 1, wherein the filler comprises at least one selected from the group consisting of spherical silica and a spherical silicone particle.

6. An electrophotographic image forming apparatus comprising an electrophotographic belt as an intermediate transfer belt, wherein the electrophotographic belt is an electrophotographic belt having an endless shape comprising:

a base body having an endless shape; and a surface layer on an outer peripheral surface of the base body, wherein grooves extending in a circumferential direction are provided on an outer surface of the surface layer;

the base body contains a thermoplastic polyester resin and a filler;

the surface layer contains an acrylic resin;

a thickness T of the base body is 30 μm or larger, and a content of the filler in the base body is 0.1% by volume to 10.0% by volume based on a total volume of the base body; and in a region having a thickness 0.25 times as thick as an average particle diameter of the filler, from a first surface of the surface layer on a side facing the base body, toward a second surface of the surface layer, the second surface being opposite to the first surface, an average value A of ratios of elements derived from the filler is 0.0 atomic % to 1.0 atomic %.

* * * * *